US005311891A

United States Patent [19]

Uchino

[11] Patent Number: 5,311,891

[45] Date of Patent: May 17, 1994

[54] SOLVENT RECOVERING SYSTEM FOR A CLEANING MACHINE

[75] Inventor: Masahide Uchino, Tokyo, Japan

[73] Assignee: Japan Field Company, Ltd., Tokyo, Japan

[21] Appl. No.: 821,881

[22] Filed: Jan. 17, 1992

Related U.S. Application Data

[63] Continuation-in-part of Ser. No. 505,388, Apr. 6, 1990, abandoned.

[30] Foreign Application Priority Data

Apr. 11, 1989 [JP] Japan ..... 1-91140

[51] Int. Cl.[5] ..... B08B 3/06; B08B 15/02

[52] U.S. Cl. ..... 134/46; 134/52; 134/61; 134/109

[58] Field of Search ..... 134/61, 76, 83, 105, 134/107, 108, 109, 111, 135, 46, 50, 52; 202/170; 118/61, 64

[56] References Cited

U.S. PATENT DOCUMENTS 4,101,340 7/1978 Rand ..... 134/109 X
4,471,792 9/1984 Koblenzer ..... 134/83
4,558,524 12/1985 Peck et al. ..... 134/105 X
4,694,527 9/1987 Yoshizawa ..... 134/61 X
4,911,189 3/1990 Halbert ..... 134/105 X

FOREIGN PATENT DOCUMENTS 463285 4/1951 Italy ..... 134/105

*Primary Examiner*—Philip R. Coe
*Attorney, Agent, or Firm*—Lowe, Price, LeBlanc & Becker

[57] ABSTRACT

A solvent recovering system capable of recovering the solvent wetting solvent-cleaned articles, such as machine parts, electronic parts or medical instruments, without releasing the solvent into the atmosphere. A solvent vapor processing unit is connected by circulation passages to a closed chamber for accommodating solvent-cleaned articles. The vapor of the solvent evaporated from the solvent-cleaned articles is circulated through the closed chamber and the solvent vapor processing unit to subject the vapor repeatedly to adsorption or condensation to recover the solvent perfectly so that the solvent may not be released into the atmosphere to prevent air pollution and harm on health.

2 Claims, 5 Drawing Sheets

SOLVENT RECOVERING SYSTEM FOR A CLEANING MACHINE

This application is a continuation-in-part of application Ser. No. 07/505,388 filed Apr. 6, 1990, and now abandoned.

BACKGROUND OF THE INVENTION

1. Field of the Invention

The present invention relates to a solvent recovering system for a cleaning machine for cleaning articles, such as machine parts, electronic parts or medical instruments, to remove the solvent from solvent-cleaned articles and to recover the same without releasing the solvent into the atmosphere.

2. Description of the Prior Art

It has been a conventional practice to take out cleaned articles from a cleaning tank and to subject the articles to natural drying or to forced drying to remove the solvent wetting the articles, so that the solvent is released in vapor into the atmosphere. Accordingly, injurious solvents, the dispersion of which in the atmosphere is not desirable, such as trichloroethylene and trichlorotrifluoroethane, are harmful to health and cause air pollution.

Known solvent recovering systems for recovering such solvents employ an adsorbent or a condenser. These known solvent recovering systems are unable to remove such injurious solvents perfectly from gases containing the injurious solvents because the gases containing the injurious solvents are passed only once through the solvent recovering systems.

SUMMARY OF THE INVENTION

The present invention has been made to solve the foregoing problems, and it is therefore an object of the present invention to provide a closed solvent recovering system capable of removing solvent from articles, such as machine parts, electronic parts or medical instruments, cleaned by liquid-phase cleaning or vapor-phase cleaning and wetted by the solvent, and capable of recovering the solvent without injurious solvent being released into the atmosphere during the solvent recovery process. Release of solvent is also prevented during the transfer of cleaned articles from a cleaning machine to the solvent recovering system.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
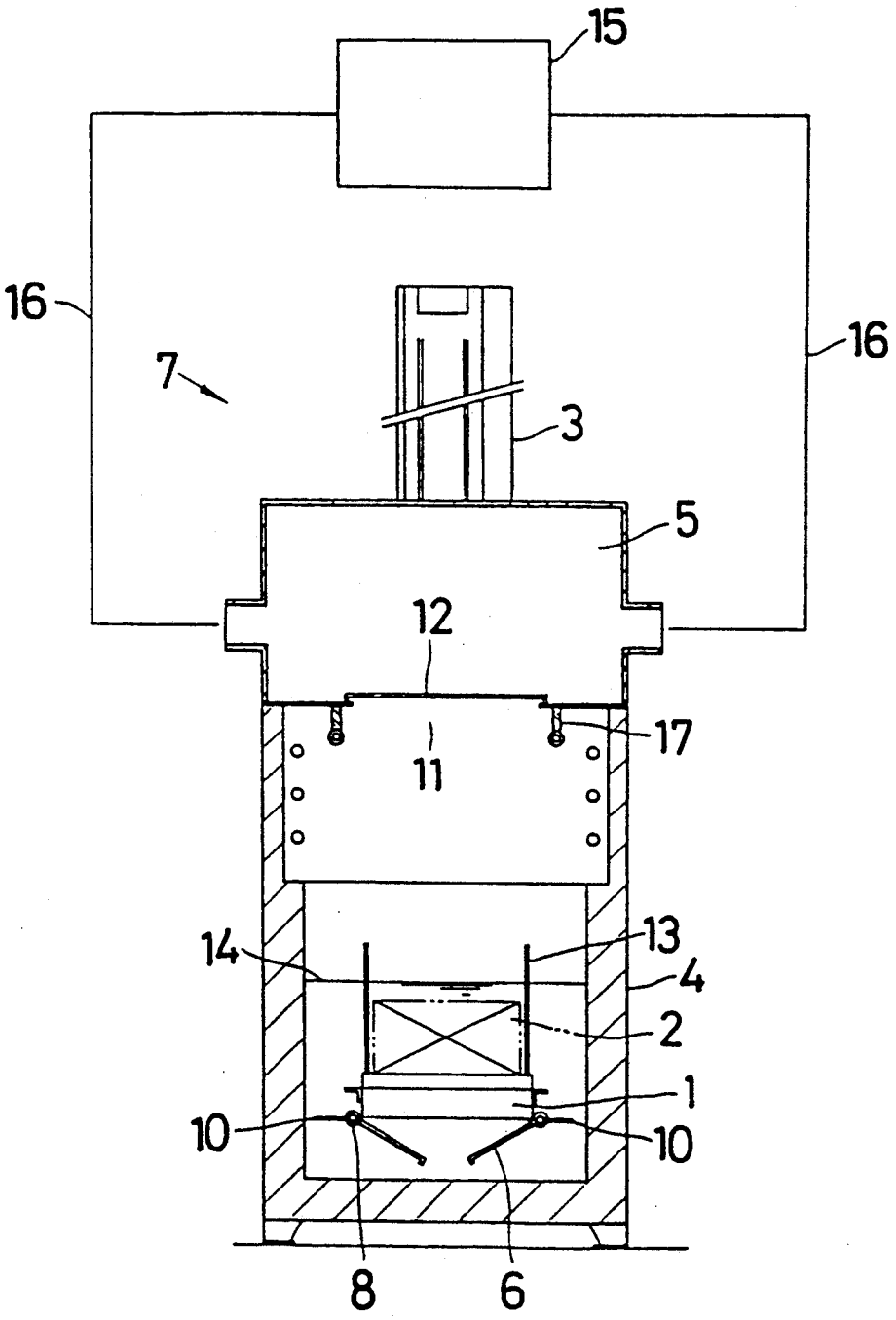
FIG. 1 is a schematic sectional view of a cleaning machine equipped with a solvent recovering system in a first embodiment according to the present invention, in a cleaning operation.

Preferred embodiments of the present invention will be described hereinafter with reference to the accompanying drawings, in which like or corresponding parts are denoted by the same reference characters.

Figure 2:
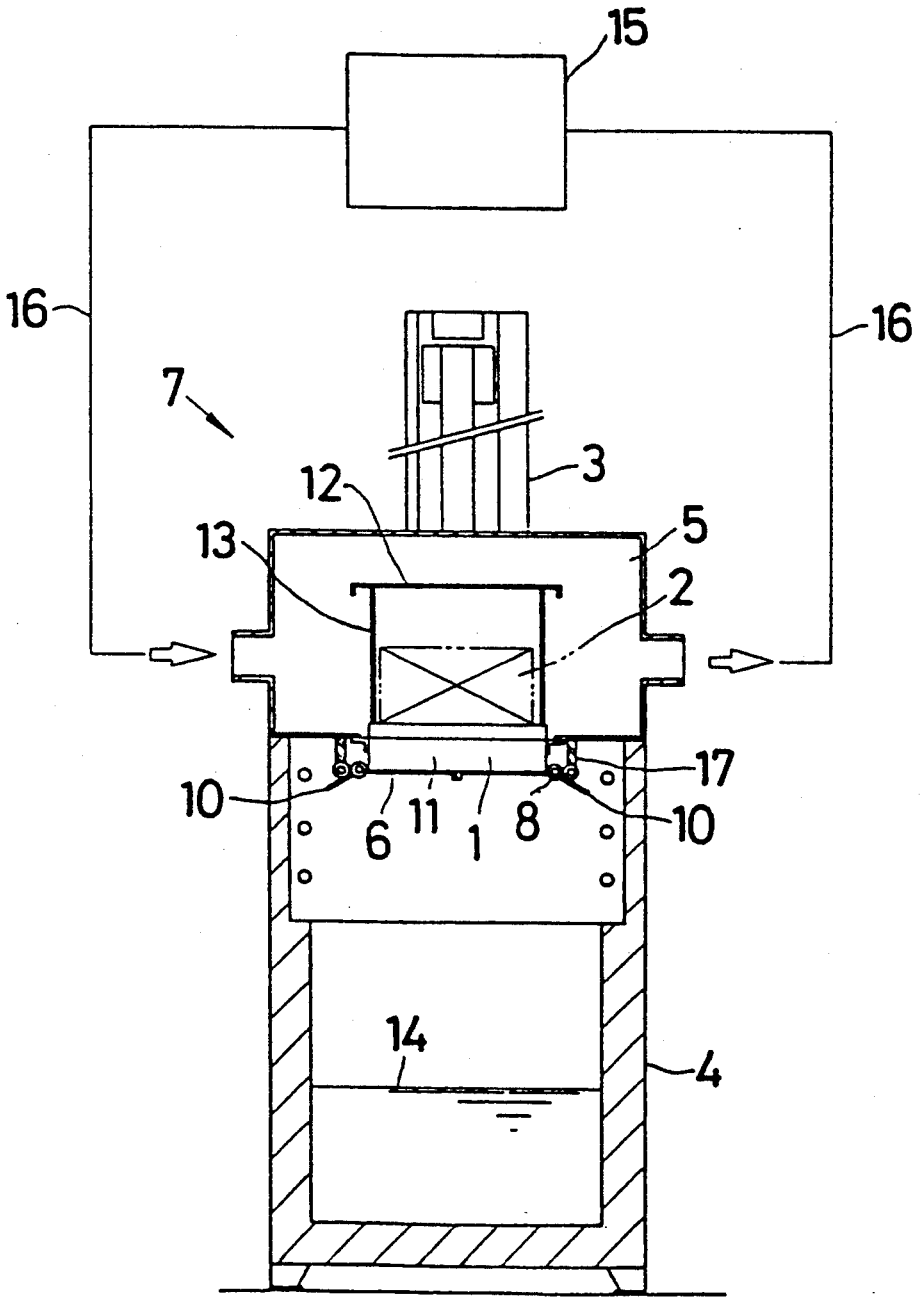
FIG. 2 is a sectional view, similar to FIG. 1, showing the cleaning machine in a solvent recovering operation.

First Embodiment (FIGS. 1 and 2)

Referring to FIGS. 1 and 2, a cleaning table 1 for supporting articles 2 to be cleaned is vertically movable. The cleaning table 1 is shifted vertically between a cleaning chamber 4 for cleaning the articles 2 mounted on the cleaning table 1 and a treatment chamber 5 disposed above the cleaning chamber 4 by an appropriate shifting mechanism 3 provided with a driving device, such as a pneumatic cylinder actuator, a hydraulic cylinder actuator or a chain-drive mechanism. The cleaning chamber 4 and the treatment chamber 5 can be isolated from each other by a pair of flat doors 6 fixed respectively to support shafts 8 rotatably supported respectively at the opposite ends of the lower surface of the cleaning table 1. The connected cleaning chamber and treatment chamber are also isolated from the external environment. Operating arms 10 are fixed to the shafts 8 so as to extend outward from the opposite sides of the lower surface of the cleaning table 1, respectively. Pressing members 17 are attached to the bottom wall of the treatment chamber 5 at Positions corresponding to the operating arms 10. An opening 11 is formed in the bottom wall of the treatment chamber 5 to receive the cleaning table 1 therethrough into the treatment chamber 5. As the cleaning table 1 is raised into the treatment chamber 5, the operating arms 10 are brought into engagement with the pressing members 17 and, as the cleaning table 1 is raised further, the operating arms 10 are pressed by the pressing members 17 to swing the doors 6 in a closing direction, and the opening 11 is closed by the doors 6 upon the arrival of the cleaning table 1 at a predetermined position within the treatment chamber 5. Thus, the cleaning chamber 4 and the treatment chamber S are isolated from each other by the doors 6 while the cleaning table 1 is held in the treatment chamber 5. Gas cannot pass from one chamber to the other. The doors 6 may be substituted by any suitable closing means capable of closing the opening 11, such as a shutter.

Normally, the opening 11 formed in the bottom wall of the treatment chamber 5 is covered with a simple lid 12 provided in the treatment chamber 5 to keep the opening 11 closed while the cleaning table 1 supporting the articles 2 is placed within the cleaning chamber 4. When the cleaning table 1 is raised, the lid 12 is lifted up as shown in FIG. 2 by rods 13 projecting upward from the upper surface of the cleaning table 1 to open the opening 11.

A solvent recovering unit 15 for recovering a solvent 14 wetting the article 2 from the articles 2 is connected by circulation passages 16 to the treatment chamber 5 to circulate a gas containing the vapor of the solvent 14 through the treatment chamber 5 and the solvent recovering unit 15. The solvent recovering unit 15 may be provided with an adsorbent, such as activated carbon, capable of adsorbing the solvent 14 or a cooling device capable of condensing the vapor of the solvent 14. During the solvent recovering process gas from the treatment chamber and circulation passage cannot leak to the external environment.

In subjecting the articles 2, such as machine parts, electronic parts or medical instruments, to liquid-phase cleaning or vapor-phase cleaning, the shifting mechanism 3 is actuated to place the cleaning table 1 supporting the articles 2 within the cleaning chamber 4 for the liquid-phase cleaning and/or vapor-phase cleaning of the articles 2. After the articles 2 have thus been cleaned, the shifting mechanism 3 raises the cleaning table 1 supporting the articles 2 to place the cleaning table 1 supporting the articles 2 within the treatment chamber 5 disposed above the cleaning chamber 4. Then, the opening 11 is closed automatically by the doors 6 in the previously stated manner to isolate the cleaning chamber 4 and the treatment chamber 5 from each other. The doors 6 may be operated manually to close the opening 11, the opening 11 may be closed by any other suitable closing means, such as a shutter, and the closing means may be operated manually or may be operated automatically to close the opening 11 upon the detection of placement of the cleaning table 1 supporting the articles 2 in place within the treatment chamber 5 by an appropriate sensor.

The gas containing the vapor of the solvent is circulated repeatedly and continuously through the treatment chamber 5, the circulation passages 16 and the solvent recovering unit 15 until the vapor of the solvent is removed completely from the gas by the solvent recovering unit 15, so that the residual solvent 14 on the articles 2 can surely be removed from the articles 2. After the solvent has completely been removed from the articles 2, the articles 2 are taken out from the treatment chamber 5, so that the injurious gas containing the solvent is not released into the atmosphere and the operator is able to carry out the cleaning operation safely without inhaling the injurious gas.

Since the articles 2 wetted by the solvent 14 is transferred from the cleaning chamber 4 to the treatment chamber 5 for solvent removal without being exposed to the external atmosphere and the articles 2 need not be transported to the solvent recovering unit 15 by a transporting device, the solvent 14 is prevented from dispersing into the atmosphere.

Figure 3:
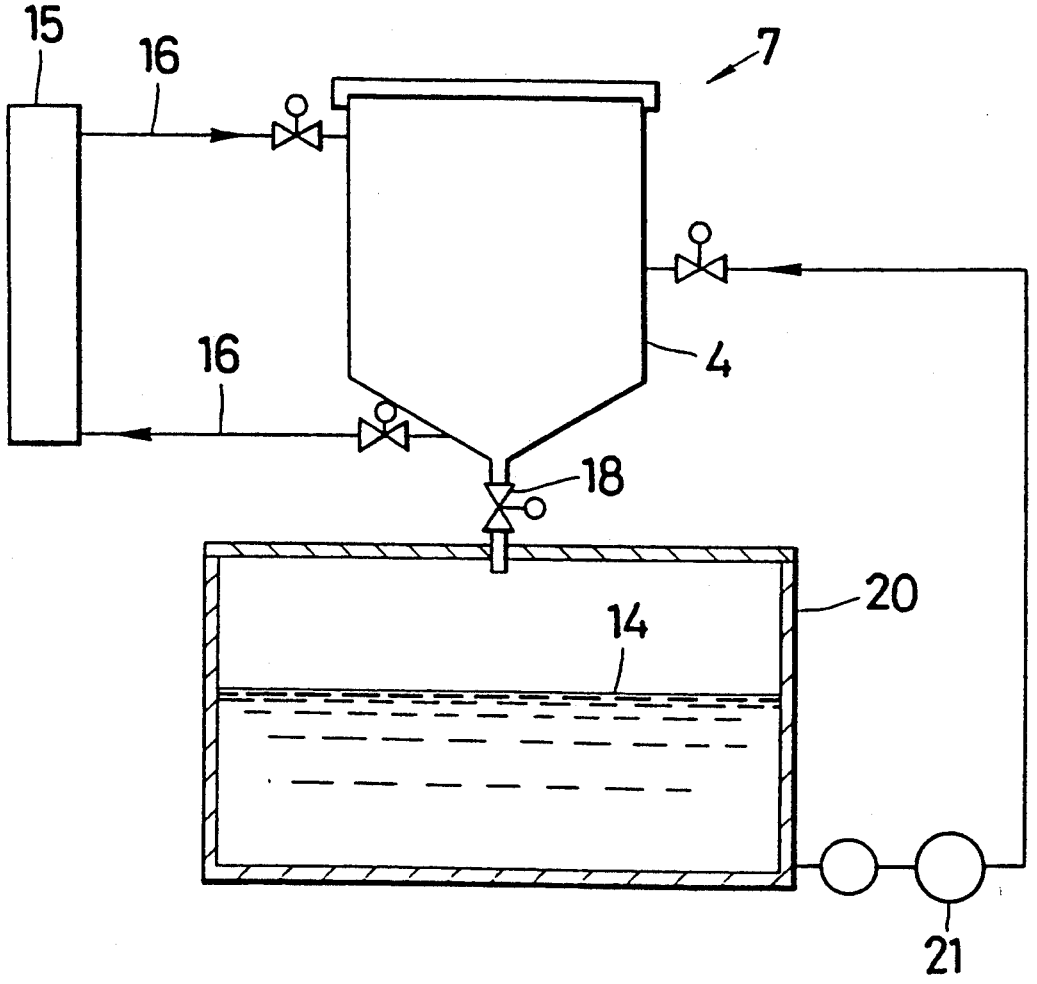
FIG. 3 is a schematic sectional view of a cleaning machine equipped with a solvent recovering system in a second embodiment according to the present invention.

Second Embodiment (FIG. 3)

Referring to FIG. 3, a cleaning tank 4 is provided with a cleaning mechanism. The cleaning tank 4 is connected through a drain valve 18 (solvent draining means) to a solvent reservoir tank 20 for containing a solvent 14. The solvent 14 is supplied from the solvent reservoir 20 to the cleaning tank 4 by a pump 21 (solvent supply means). The cleaning tank 4 serves also as an evaporation chamber.

After the cleaning operation has been completed, the drain valve 18 is opened to drain the solvent 14 completely from the cleaning tank 14 into the solvent reservoir tank 20, and then a solvent recovering unit 15 is actuated. A gas containing the vapor of the solvent 14 is circulated repeatedly through the cleaning tank 4 serving also as an evaporation chamber, circulation passages 16 and the solvent recovering unit 15 to remove the solvent evaporated from the articles 2 completely from the gas. After the solvent has thus been removed completely, the articles 2 are taken out from the cleaning tank 4. In case the cleaning tank 4 requires maintenance or repair, the solvent 14 contained in the cleaning tank 4 is removed completely by the same procedure to prevent the solvent 14 from dispersing into the atmosphere. The use of the cleaning tank 4 also for evaporating the solvent simplifies the cleaning machine.

Figure 4:
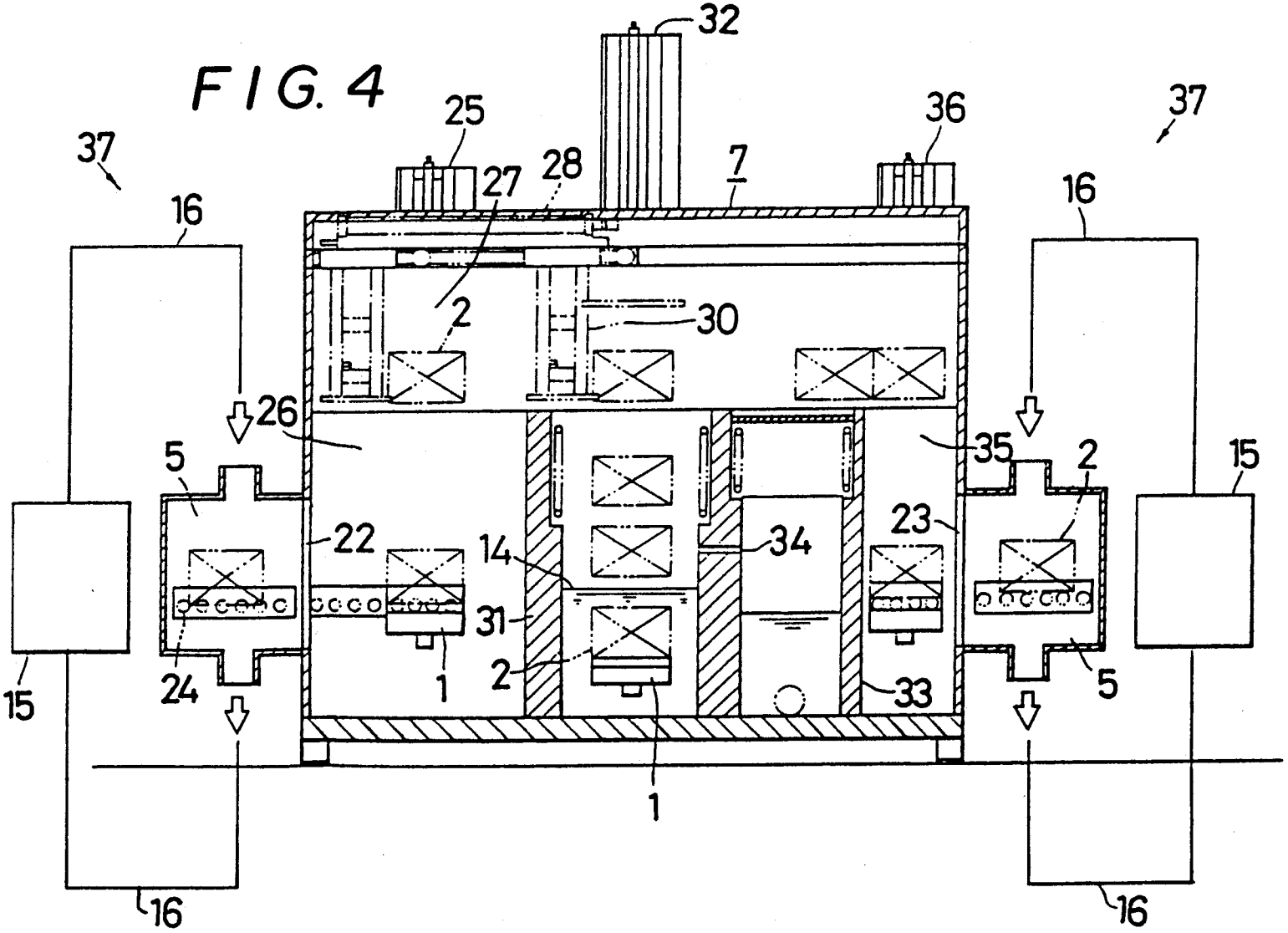
FIG. 4 is a schematic sectional view of a cleaning machine equipped with a solvent recovering system in a third embodiment according to the present invention.

Third Embodiment (FIG. 4)

A solvent recovering system in a third embodiment according to the present invention is incorporated into an existing cleaning machine 7 as shown in FIG. 4. Referring to FIG. 4. The cleaning machine 7 is provided with an inlet opening 22 and an outlet opening 23 respectively in its opposite side walls. Articles 2 to be cleaned are put into the cleaning machine 7 through one of the openings, for example, the inlet opening 22, and are taken out through the other opening, for example, the outlet opening 23. While the articles 2 are transported through the cleaning machine 7 from the inlet opening 22 to the outlet opening 23, the articles 2 are cleaned perfectly. The articles 2 fed by a conveyor 24 through the inlet opening 22 to the cleaning machine 7 are lifted through a lifting chamber 26 by a lifter operated by a vertical cylinder actuator 25 disposed outside the cleaning machine 7 to an upper transporting chamber 27 of the cleaning machine 7. Then, the articles 2 are placed on a carriage 30 operated by a horizontal cylinder actuator 28 for horizontally transporting the articles 2. The carriage 30 transports the articles 2 into a liquid-phase cleaning chamber 31 formed contiguously with the lifting chamber 26. Then, the articles 2 are immersed in a solvent 14 contained in the cleaning chamber 31 by a vertical cylinder actuator 32 for liquid-phase cleaning. A cleaning vapor is supplied from a vapor producing chamber 33 formed contiguously with the liquid-phase cleaning chamber 31 through a passage 34 into the liquid-phase cleaning chamber 31 for vapor-phase cleaning in a space over the solvent 14 contained in the liquid-phase cleaning chamber 31. After the completion of vapor-phase cleaning, the articles 2 are transported horizontally by the carriage 30 to a position above a lowering chamber 35, the articles 2 are lowered through the lowering chamber 35 by a vertical cylinder actuator 36, and then the articles 2 are taken outside the cleaning machine 7 through the outlet opening 23.

Solvent recovering systems 37 are joined respectively to the opposite side walls of the cleaning machine 7 by suitable means, such as bolts or welding, so as to communicate with the interior of the cleaning machine 7 respectively by means of the openings 22 and 23. The solvent recovering system 37 must be provided on the side of the outlet opening 23. It is desirable to provide the solvent recovering system 37 also on the side of the inlet opening 22. Treatment chambers 5 are connected respectively to the inlet opening 22 and the outlet opening 23. Solvent recovering units 15 are connected to the treatment chambers 5 by circulation passages 16 to recover the solvent evaporated from the articles 2 and the solvent discharged from the cleaning machine 7 through the openings 22 and 23 into the treatment chambers 5.

Figure 5:
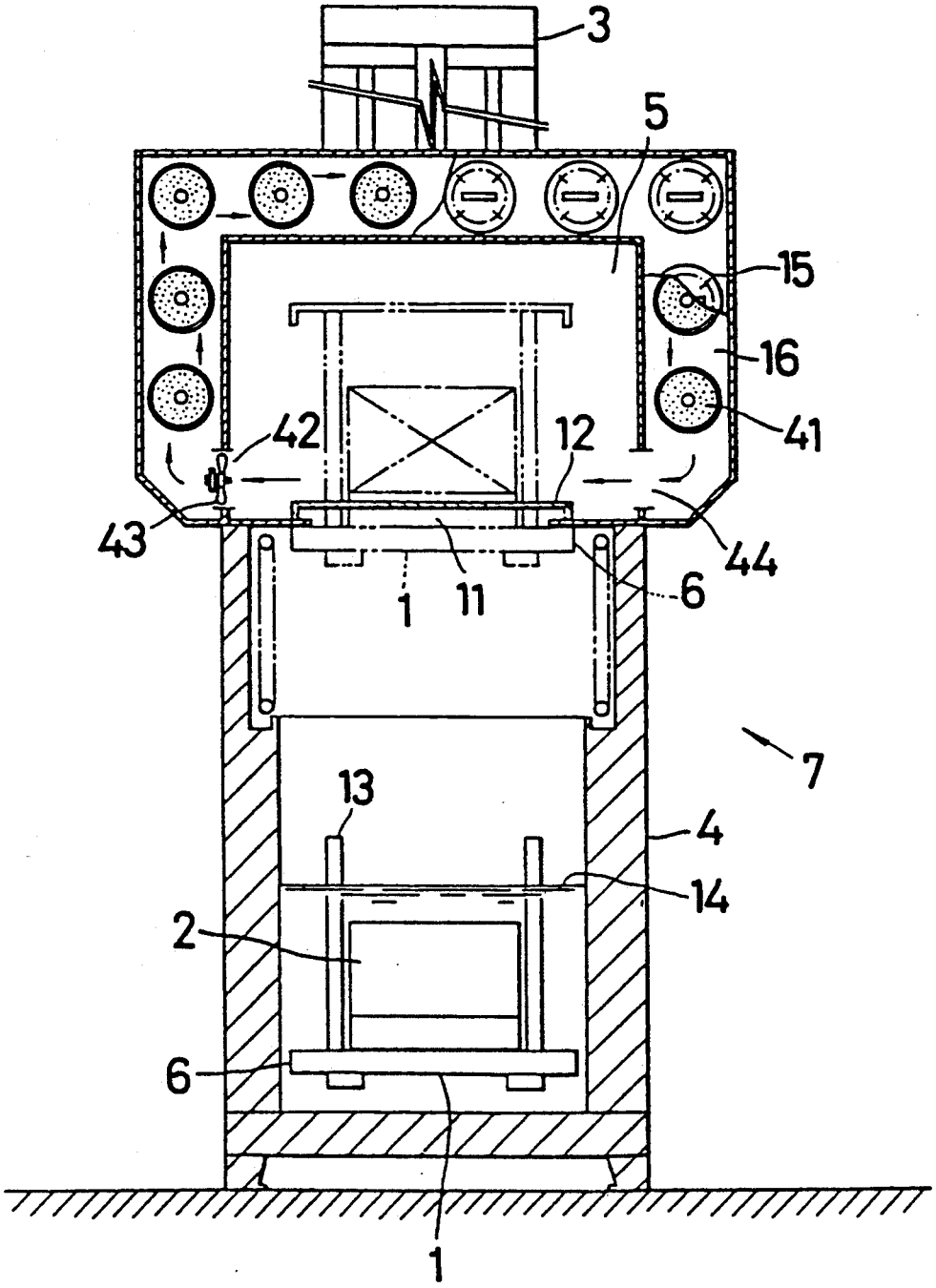
FIG. 5 is a schematic sectional view of a cleaning machine equipped with a solvent recovering system in a fourth embodiment according to the present invention.

Fourth Embodiment (FIG. 5)

As shown in FIG. 5, a solvent recovering system in a fourth embodiment according to the present invention is constructed integrally with a cleaning machine 7. A circulation passage 16 is formed over the cleaning machine 7 and a solvent recovering unit 15 comprising a plurality of solvent recovering elements is disposed within the circulation passage 16.

The cleaning machine 7 has a cleaning chamber 4 and a treatment chamber 5 formed on top of the cleaning chamber 4. An opening 11 is formed in the bottom wall of the treatment chamber 5 and is covered with a lid 12 to close the opening 11 while articles 2 are being cleaned in the cleaning chamber 4. The articles 2 are mounted on a cleaning table 1. The size of the cleaning table 1 is greater than that of the opening 11. When the cleaning table 1 is raised to its uppermost position, the lid 12 is lifted up by rods 13 attached upright to the cleaning table 1, and the opening 11 is closed by the cleaning table 1 as indicated by alternate long and two short dashes lines in FIG. 5 to isolate the cleaning chamber 4 and the treatment chamber 5 from each other.

The circulation passage 16 is formed around the treatment chamber 5, and the solvent recovering unit 15 is disposed within the circulation passage 16. Each solvent recovering element is provided with a replaceable cartridge containing an adsorbent 41 capable of adsorbing the solvent, such as activated carbon. A fan 43 for forcing the vapor of the solvent to flow into the circulation passage 16 is disposed near an outlet opening 42 formed in one side wall of the treatment chamber 5, and an inlet opening 44 is formed in the opposite side wall of the treatment chamber 5 for the forced circulation of the gas containing the vapor of the solvent through the circulation passage 16. Because of the configuration of the passage 16 and the entrances from the passage to the treatment chamber, the gas returning to the treatment chamber is forcibly propelled against the solvent-cleaned articles 2 to more efficiently volitize residual solvent and transport the volitized solvent away from the solvent-cleaned articles 2.

After raising the cleaning table to its uppermost position indicated by alternate long and two short dashes lines in FIG. 5, where the upper surface of the cleaning table 1 is in close contact with the lower surface of the bottom wall of the treatment chamber 5 to close the opening 11 so that the cleaning chamber 4 and the treatment chamber 5 are isolated from each other, the fan 43 is actuated to circulate the air containing the vapor of the solvent forcibly through the circulation passage 16 and thereby the solvent contained in the circulated air is more rapidly adsorbed by forcibly propelling the solvent vapor into the adsorbent 41. The air is circulated repeatedly and continuously through the circulation passage 16 and the treatment chamber 5 to recover completely the solvent evaporated from the articles 2 by the solvent recovering unit 15. After the solvent has completely been recovered, the articles 2 are taken out from the treatment chamber 5. Thus, the dispersion of the injurious gas into the atmosphere is prevented and the operator is able to engage safely in the cleaning operation without inhaling the injurious gas. The replaceable cartridges of the solvent recovering unit 15 facilitate changing the adsorbent 41, so that the solvent recovering unit 15 is able to function constantly at a high adsorption efficiency. As shown in FIG. 5 fan 42 is drawing air into the treatment chamber 5. However, the fan can be arranged to propel air directly at the solvent-cleaned articles in the treatment chamber.

Thus, according to the present invention, the treatment chamber for containing articles, such as machine parts, electronic parts or medical instruments, cleaned by liquid-phase cleaning or vapor-phase cleaning and wetted by the solvent, and the solvent recovering unit are connected by the circulation passages to circulate the vapor of the solvent evaporated from the articles wetted by the solvent repeatedly and continuously through the solvent recovering unit. Accordingly, even a solvent difficult to recover by a single cycle of circulation through the solvent recovering unit can surely be recovered. The dispersion of the solvent can be prevented by taking out the articles from the treatment chamber after the solvent evaporated from the articles has completely been removed and recovered from the gas circulated through the solvent recovering unit.

If it is desired to recover the solvent evaporated from the articles by a single cycle of circulation through a solvent recovering unit, the solvent recovering system must have a large solvent recovering ability, the solvent recovering system must be constructed in a large size, and hence the solvent recovering system will be expensive. According to the present invention, since the gas containing the vapor of the solvent is circulated repeatedly and continuously through the solvent recovering unit, the circulation passages and the treatment chamber, the solvent can completely be removed from the circulated gas even if the solvent recovering ability of the solvent recovering unit is comparatively small. Accordingly, the solvent recovering system of the present invention is relatively small in size, is inexpensive and is highly capable of removing the solvent from the gas containing the vapor of the solvent.

Furthermore, since the gas containing the vapor of the solvent is circulated through the circulation passages between the treatment chamber and the solvent recovering chamber and no gas is discharged outside the solvent recovering system, the solvent recovering system does not need any discharge duct, is inexpensive and requires relatively small floor space. Still further, since the gas is not discharged outside the solvent recovering system and no air is introduced into the solvent recovering system, there is no possibility that moisture contained in the atmosphere is mixed in the recovered solvent, and hence the recovered solvent has a high purity.

What is claimed is:

1. A solvent recovering system for recovering residual solvent from solvent-cleaned articles processed in a cleaning machine associate with said solvent recovering system comprising:

a treatment chamber connected to said cleaning machine;

isolating means for isolating said treatment chamber from said cleaning machine, a cleaning table for supporting said solvent cleaned articles and moveable between said cleaning machine and said treatment chamber;

said isolating means comprising a pair of shafts rotatably supported at the opposite ends of the lower surface of the cleaning table, a pair of doors attached for swing motion respectively to the pair of shafts, a pair of arms attached respectively to the pair of shafts so as to extend outward of the cleaning table, and a pair of pressing members attached to a wall separating the treatment chamber and the cleaning machine at positions corresponding to the pair of arms, respectively, to press the arms to cause the pair of doors to swing on the pair of shafts and to close an opening formed in the wall of the treatment chamber to isolate the treatment chamber and the cleaning machine upon the cleaning table being moved to a predetermined location within the treatment chamber;

solvent recovering means for separating solvent from a gas containing vapor of the solvent; and circulation means for continuously and repeatedly circulating a gas containing a vapor of the solvent between said treatment chamber and said solvent recovering means;

wherein gas containing vapor of the solvent is isolated from outside atmosphere and remains within the associated cleaning machine or solvent recovery system separate from gas external to said cleaning machine and said solvent recovering system.

2. The solvent recovering system of claim 1, wherein said isolating means can be externally operated for closing or opening an opening formed in a wall separating the treatment chamber and the cleaning machine.

* * * * *